United States Patent [19]

Mathys

[11] 4,132,061

[45] Jan. 2, 1979

[54] WATCH MOVEMENT

[75] Inventor: Pierre Mathys, Begnins, Switzerland

[73] Assignee: Bouchet-Lassale S.A., Geneva, Switzerland

[21] Appl. No.: 764,686

[22] Filed: Feb. 1, 1977

[30] Foreign Application Priority Data

Feb. 18, 1976 [CH] Switzerland ..... 1963/76

[51] Int. Cl.[2] ..... G04B 19/24

[52] U.S. Cl. ..... 58/59; 58/82 R; 58/140 R

[58] Field of Search ..... 58/28 R, 28 D, 7, 57, 58/59, 63, 82 R, 86, 116 R, 117, 136, 140 R, 140 A; 74/1.5, 3.54, 21, 99 R; 308/139, 159, 188, 189

[56] References Cited

U.S. PATENT DOCUMENTS

| | | | |
|---|---|---|---|
| 1,907,792 | 5/1933 | Greenleaf | 58/140 R X |
| 2,559,461 | 7/1951 | Pichette | 58/140 R X |
| 2,789,413 | 4/1957 | Cachelin | 58/82 A |
| 2,867,971 | 1/1959 | Bertsch et al. | 58/82 A |
| 3,375,654 | 4/1968 | Jeanmonod | 58/59 |
| 3,517,500 | 6/1970 | Giger | 58/82 |
| 3,945,197 | 3/1976 | Erard | 58/59 |

FOREIGN PATENT DOCUMENTS

| | | | |
|---|---|---|---|
| 1050274 | 2/1959 | Fed. Rep. of Germany | 58/140 R |
| 378234 | 11/1963 | Switzerland | 58/140 R |

*Primary Examiner*—Robert K. Schaefer
*Assistant Examiner*—Vit W. Miska
*Attorney, Agent, or Firm*—Young & Thompson

[57] ABSTRACT

An extra-thin manually or automatically wound watch movement in which at least one wheel is pivoted in an overhang position by means of a single-race miniaturized ball bearing.

2 Claims, 12 Drawing Figures

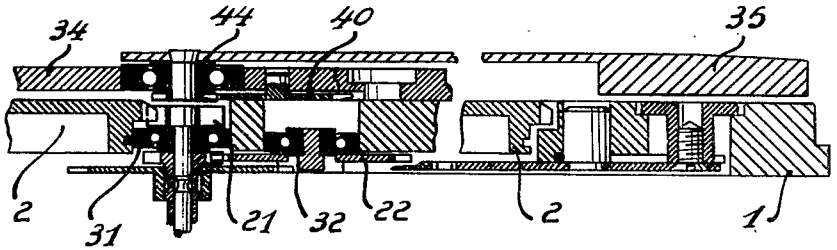
FIG.4
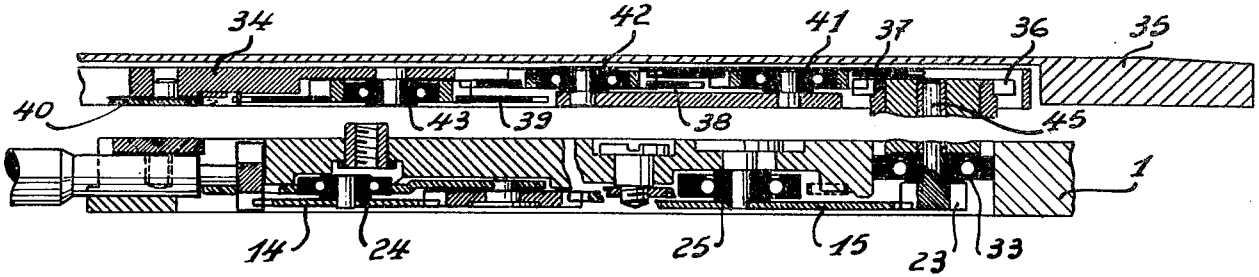
FIG.4A
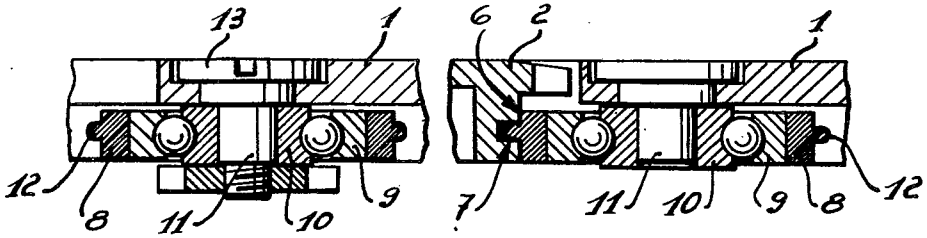
FIG.6A
FIG.6

WATCH MOVEMENT

The present invention relates to a very thin watch movement that can be wound manually or automatically.

The purpose of the present invention is to produce an extra-flat time-piece which has a maximum thickness of 1.5 mm in its manually wound form and a maximum thickness of 2.4 mm in its automatically wound form.

The said purpose is achieved by the fact that at least two wheels of the time-piece are pivoted in overhang or cantilevered position by means of a single-race, miniaturised ball bearing.

By the term "wheels", it is to be understood here all the elements of a time-piece which are movable, especially either rotatable or oscillable.

The attached drawings show diagrammatically by way of example two embodiments of the watch movement in accordance with the invention, one being wound manually and the other automatically.

FIGS. 4 and 4A are section along the lines IV—IV and IVA—IVA, respectively in FIGS. 3 and 5 of the second embodiment.

FIGS. 6 and 6A are sectional views of the pivoting of the barrel along the lines VI—VI in FIG. 1 for both embodiments of the movement in accordance with the invention.

Figure 1:
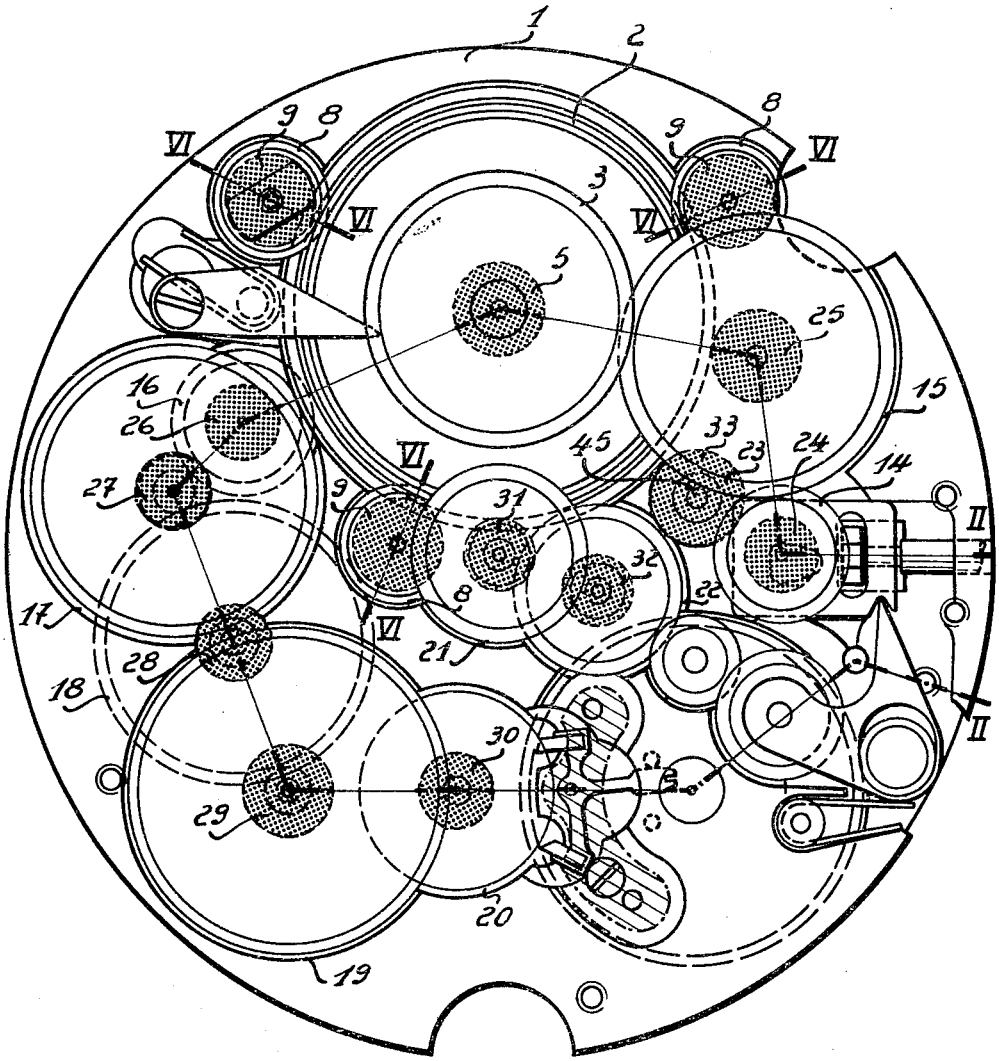
FIG. 1 shows a view from below of the movement in a first embodiment.

The objective envisaged, namely the production of extra-flat movements, has become attainable by applying three new principles in the pivoting of the wheels in the movement.

1. Generally all the wheels turn in the same direction all the time, but in practice two or three wheels of the motor mechanism or at least two or three wheels of the automatic winding mechanism are pivoted in an overhang position that is, mounted on a shaft that is supported only at one end, with the aid of a mounting formed by a miniaturised ball bearing.

Thanks to this arrangement, it is possible to eliminate all the bridges and the movement can be made in such a way that at any point in it a sectional view will not reveal two or more fixed parts disposed one above another. In fact a sectional view of the movement shows that at any point at most one fixed part (part of the plate) and two wheels or movable elements are disposed one above another. This means a considerable saving in thickness.

The precision of the miniaturised ball bearings is sufficient for the wheels to be pivoted, that is, in rotatable sliding contact with a fixed part, on one of their faces only. This arrangement offers yet another considerable advantage, namely, ease of assembly. Each wheel (the wheels being entirely conventional gear wheels, balance wheels, spring drums, etc., except as pointed out below) has a spindle driven into the inner cage of a ball bearing and thus is rigidly locked to this bearing. The outer cage of the bearing is then driven into a corresponding housing in the plate 1 and the wheel automatically finds its working position, and it is no longer necessary to make adjustments to or carry out setting or centering work on the pivots of a wheel as is the case with traditional movements.

2. The barrel or spring drum 2 is pivoted that is, mounted for rotation, at its periphery in such a way that the full height of the movement is available for the drum ratchet 3 and the drum 2. In extra-flat or thin movements it is important to have a maximum amount of height for the drum 4 of the barrel (pivoted on ball bearing), since the breadth of the spring is determined by this, in order to obtain an adequate working reserve. In one variant the spring-drum ratchet can be pivoted on the centre of the spring drum.

To this end, the periphery of the cage 6 of the barrel or spring drum exhibits a circular groove 7 which receives at least three small wheels or rollers 8. Each small wheel is pivoted on a ball bearing 9 the internal cage 10 of which is driven onto a spindle 11 which is itself driven into the plate 1. The outer cages of these ball bearings exhibit a flange 12 which engages in the groove 7 of the spring drum. One of the small wheels is mounted on the plate in such a way as to be detachable by means of a screw 13 for example for locating the spring drum. Thus with the spring drum 2 pivoted and supported by its periphery, the full height of the movement is available (see FIGS. 6 and 6A).

Figure 2:
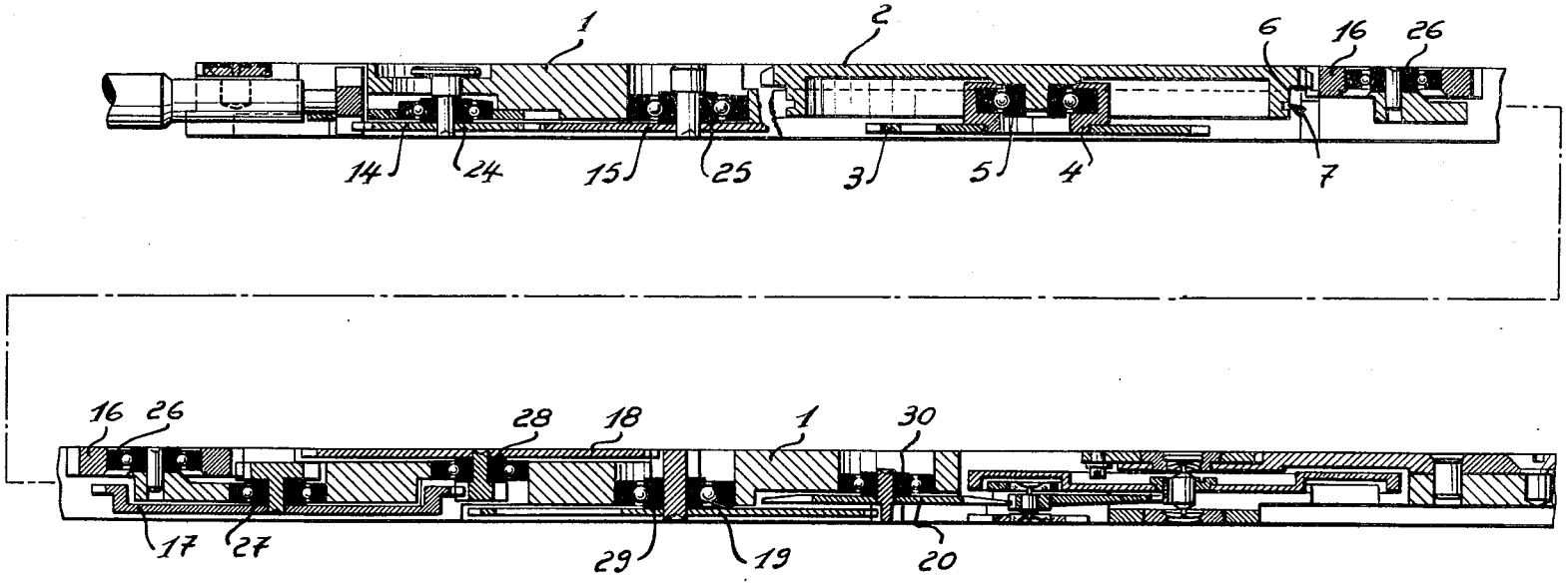
FIG. 2 is a sectional view of the first embodiment along the line II—II in FIG. 1.

It should be noted that the wheels 14 to 23 of the manual winding mechanism are preferably pivoted in an overhang position as well with the aid of miniaturised ball bearings 24 to 33, as shown more particularly with reference to FIGS. 1 and 2.

Figure 3:
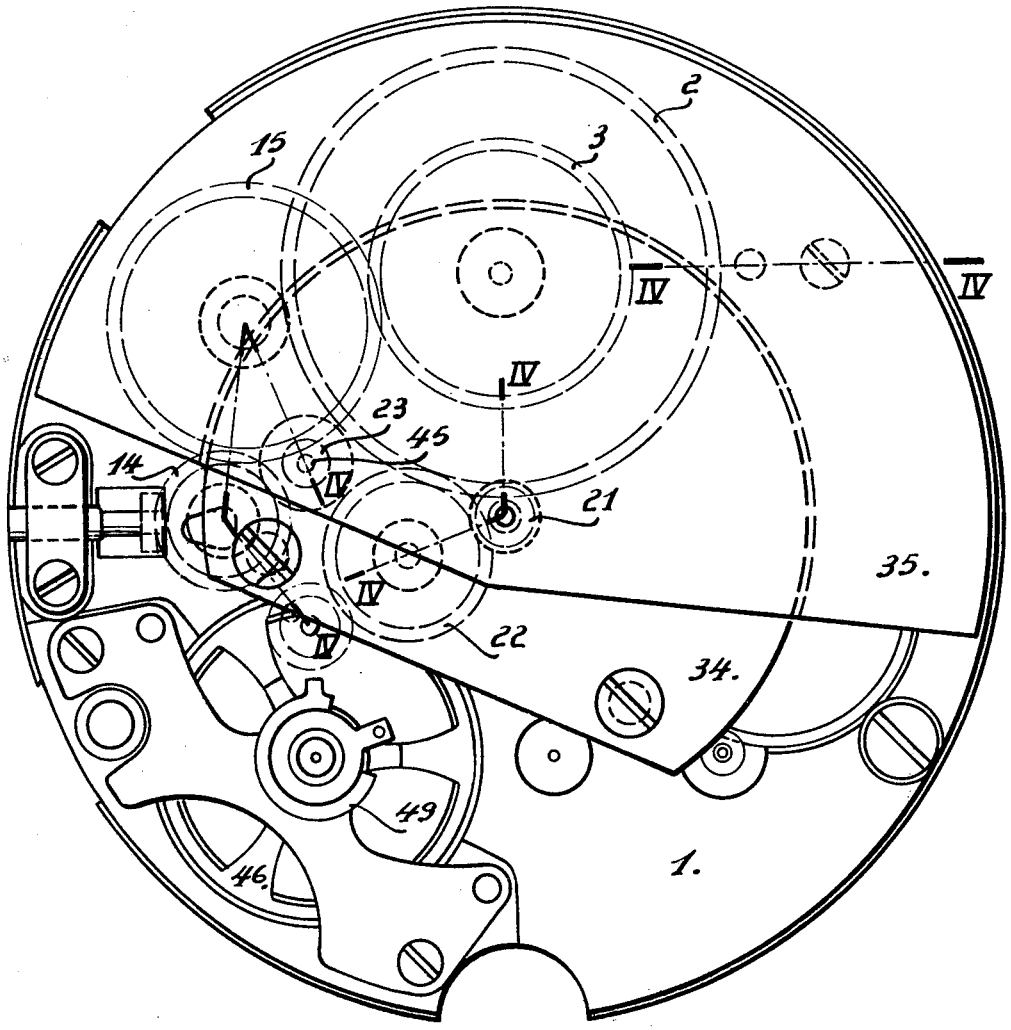
FIG. 3 shows a top view of the plate of a second embodiment.
Figure 5:
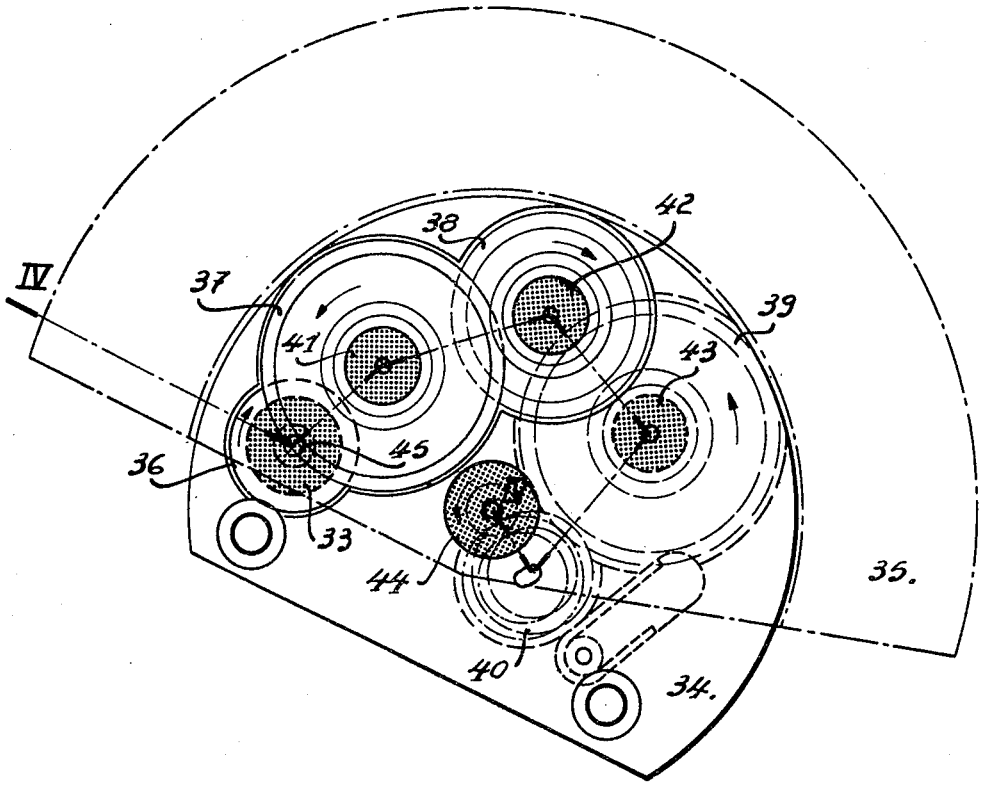
FIG. 5 is a top view of the automatic winding device for the second embodiment.

3. Movements with automatic winding (see FIGS. 3 to 5) have an automatic plate 34 which carries and pivots the oscillating mass 35 and all the wheels of the automatic winding mechanism 36 to 40. This is quite conventional and so is only schematically illustrated in the drawings. But according to the present invention, all these wheels, or at least two of them, are also pivoted in an overhang position with the aid of miniaturised ball bearings 41 to 43, making it possible to reduce the height of this mechanism very considerably. The winding mass 35 is also pivoted in the centre with the aid of a ball bearing 44 the external cage of which is driven into a housing in the automatic winding plate 34.

As illustrated in FIG. 4, this automatic winding plate 34 is located over the plate 1 housing the motor and manual winding mechanisms, and the last wheel 36 pivoted on the plate 34 is fixed to rotate, by means of a common spindle 45, with one of the wheels of the manual winding mechanism of plate 1 for example.

This arrangement of automatic winding mechanism is particularly advantageous because, being very thin, it can also be used easily with traditional movements.

It should also be noted that the new barrel can be incorporated into a traditional movement.

Indeed, the entire mechanism can be conventional, apart from the three points recited above, and so is shown only schematically in the drawings.

By using the solutions described and illustrated by way of example, automatic movements can be made having a thickness of less than 2.4 mm, even down to a mere 2 mm. For manually wound movements the thickness can be cut to less than 1.5 mm and reach as little as 1.2 mm.

It goes without saying that this reduction in the thickness of the movement is not obtained to the detriment of its quality, sturdiness or precision. Quite the contrary, as can be clearly seen from the attached drawings, the thickness of the wheels or the plate has not been reduced and does not lower the mechanical strength of these parts. The reduction in thickness arises primarily through the absence of bridges. In addition, the new pivoting system described guarantees perfect centering and eliminates defective bearing alignment.

In the movement in accordance with the invention one can use either a balance wheel and/or an escapement of conventional type, or a balance wheel and/or an escapement pivoted in an overhang position, each on a single ball bearing, as described previously.

Figure 7:
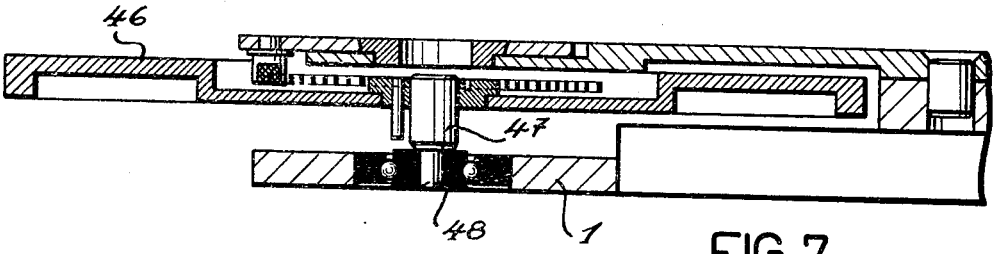
FIGS. 7, 7A, 7B and 7C are sectional views of four embodiments of the pivoting arrangement for the balance wheel of the movement in accordance with the invention.
Figure 7A:
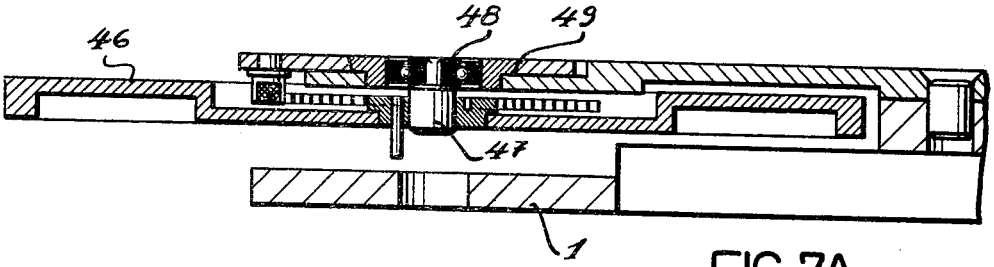
Figure 7B:
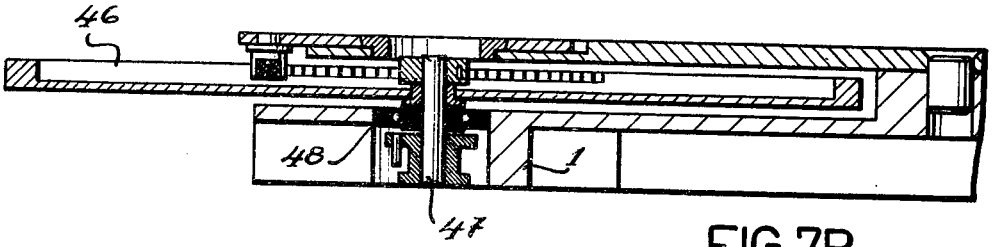
Figure 7C:
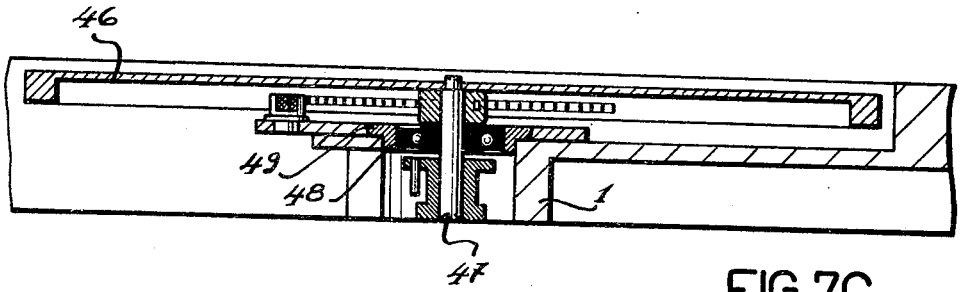

By way of example FIGS. 7, 7A, 7B and 7C in the attached drawings show four embodiments of a balance wheel 46 pivoted on a single bearing 47 in which the said bearing is mounted on a ball bearing 48 the outer cage of which is driven into a corresponding housing made, as shown in the figures from top to bottom in the attached drawing, in the plate 1 (FIG. 7), in the cock 49 disposed above the balance wheel (FIG. 7A), in the plate 1 (FIG. 7B) or in the cock 49 located under the balance wheel (FIG. 7C).

Such a balance wheel pivoted in an overhang position can naturally be used either in a conventional movement or in a movement in which other wheels are pivoted in an overhang position.

Similarly the escapement anchor can be pivoted on a single bearing and thus be used either in a conventional movement or in a movement in which other moving parts are pivoted in an overhang position.

Finally it should be noted that the term "timepiece" used in the description and the claims covers the motor, time-setting, manual winding and automatic winding mechanisms respectively (but excluding the oscillating mass), the regulator, more particularly the balance wheel, and the escapement, more particularly the anchor and the wheel of the escapement.

What we claim is:

1. In a watch movement comprising a plurality of wheels mounted for rotation on a fixed plate; the improvement in which at least one of said wheels is mounted on a shaft which is fixed at one end to said plate and which is free at its end remote from said plate, and a single race miniaturized ball bearing by which said at least one wheel is mounted on said shaft.

2. Apparatus as claimed in claim 1, in which said at least one wheel comprises all of said wheels.

* * * * *